US006656343B2

(12) United States Patent
Dancuart

(10) Patent No.: US 6,656,343 B2
(45) **Date of Patent: *Dec. 2, 2003**

(54) PROCESS FOR PRODUCING SYNTHETIC NAPHTHA FUEL AND SYNTHETIC NAPHTHA FUEL PRODUCED BY THAT PROCESS

(75) Inventor: Luis Pablo Dancuart, Sasolburg (ZA)

(73) Assignee: Sasol Technology (Pty) Ltd., Rosebank (ZA)

( * ) Notice: Subject to any disclaimer, the term of this patent is extended or adjusted under 35 U.S.C. 154(b) by 0 days.

This patent is subject to a terminal disclaimer.

(21) Appl. No.: 09/972,275

(22) Filed: Oct. 5, 2001

(65) Prior Publication Data

US 2002/0179488 A1 Dec. 5, 2002

Related U.S. Application Data

(63) Continuation-in-part of application No. PCT/ZA99/00147, filed on Dec. 23, 1999.

(60) Provisional application No. 60/128,036, filed on Apr. 6, 1999.

(30) Foreign Application Priority Data

Apr. 19, 1999 (ZA) ..... 99/2789
Oct. 12, 2000 (WO) ..... WO 00/60029

(51) Int. Cl.[7] ..... C10G 65/14; C10L 1/08

(52) U.S. Cl. ..... 208/58; 208/59; 208/80; 208/89; 208/15; 208/950; 585/14

(58) Field of Search ..... 208/59, 28, 56, 208/58, 15, 950, 89, 80; 585/14

(56) References Cited

U.S. PATENT DOCUMENTS

| | | | | |
|---|---|---|---|---|
| 3,620,696 A | * | 11/1971 | Hollyday, Jr. et al. | 44/62 |
| 5,378,348 A | | 1/1995 | Davis et al. | |
| 5,645,613 A | | 7/1997 | Benham et al. | |
| 5,689,031 A | * | 11/1997 | Berlowitz et al. | 585/734 |
| 5,814,109 A | | 9/1998 | Cook et al. | |
| 5,888,376 A | * | 3/1999 | Wittenbrink et al. | 208/59 |
| H1849 H | * | 5/2000 | Fourie et al. | 429/17 |
| 6,210,559 B1 | | 4/2001 | Cook et al. | |
| 6,248,794 B1 | * | 6/2001 | Gieskes | 518/700 |
| 6,274,029 B1 | * | 8/2001 | Wittenbrink et al. | 208/15 |
| 6,475,375 B1 | * | 11/2002 | Dancuart | 208/78 |

FOREIGN PATENT DOCUMENTS

| | | |
|---|---|---|
| BE | 459498 | 7/1945 |
| DE | 30 30998 | 4/1982 |
| EP | 0 532 116 | 3/1993 |
| WO | 00/20535 | 4/2000 |

* cited by examiner

*Primary Examiner*—Bekir L. Yildirim
(74) *Attorney, Agent, or Firm*—Merchant & Gould P.C.

(57) ABSTRACT

The invention provides a process for the production of a synthetic naphtha fuel suitable for use in compression ignition (CI) engines, the process including at least the steps of hydrotreating at least a fraction of a Fischer-Tropsch (FT) synthesis reaction product of CO and $H_2$, or a derivative thereof, hydrocracking at least a fraction of the FT synthesis product or a derivative thereof, and fractionating the process products to obtain a desired synthetic naphtha fuel characteristic. The invention also provides a synthetic naphtha fuel made by the process as well as a fuel composition and a Cloud Point depressant for a diesel containing fuel composition, said fuel composition and said depressant including the synthetic naphtha of the invention.

13 Claims, 1 Drawing Sheet

PROCESS FOR PRODUCING SYNTHETIC NAPHTHA FUEL AND SYNTHETIC NAPHTHA FUEL PRODUCED BY THAT PROCESS

This application is a continuation-in-part of International Application No. PCT/ZA99/00147, filed Dec. 23, 1999, published in English under PCT Article 21 (2)which claims benefit of provisional application No. 60/128,036 filed Apr. 6, 1999.

This invention relates to naphtha fuels useable in Compression Ignition (CI) combustion engines as well as to a process for production of such naphtha fuels. More particularly, this invention relates to naphtha fuels produced from a mainly paraffinic synthetic crude which is produced by the reaction of CO and $H_2$, typically by the Fischer-Tropsch (FT) process.

BACKGROUND TO THE INVENTION

Products of a FT hydrocarbon synthesis process, particularly the products of a cobalt and/or iron based catalytic process, contain a high proportion of normal paraffins. Primary FT products provide notoriously poor cold flow properties, making such products difficult to use where cold flow properties are vital, e.g. diesel fuels, lube oil bases and jet fuel. It is known in the art that octane number and cetane number are normally inversely related i.e. a higher octane number is typically associated with a lower cetane number. It is also known that naphtha fractions intrinsically have low cold flow characteristics like congealing and cloud points. There is thus an incentive for a process to produce a synthetic naphtha fuel obtained from the FT process which has good cold flow characteristics and a Cetane number compatible with CI engine fuel requirements. Additionally, such synthetic naphtha fuel may have acceptable biodegradability properties.

The synthetic naphtha fuel described in this invention is produced from a paraffinic synthetic crude (syncrude) obtained from synthesis gas (syngas) through a reaction like the FT reaction. The FT primary products cover a broad range of hydrocarbons from methane to species with molecular masses above 1400; including mainly paraffinic hydrocarbons and smaller quantities of other species such as olefins, and oxygenates.

The prior art teaches in U.S. Pat. No. 5,378,348 that by hydrotreating and isomerizing the products from a Fisher-Tropsch reactor one can obtain a jet fuel with freezing point of −34° C. or lower due to the isoparaffinic nature of this fuel. This increased product branching relative to the waxy paraffin feed corresponds with a Cetane rating (combustion) value less than that for normal (linear) paraffins, depicting that an increase in branching reduces the Cetane value of paraffinic hydrocarbon fuels.

Surprisingly, it has now been found by the applicant, that a hydroprocessed synthetic naphtha fuel may be produced having a Cetane number, typically in excess of 30, as well as good cold flow properties. The synthetic naphtha fuels of the present invention could be used on their own or in blends in CI engines, typically where diesel fuels are presently used. This would lead to the more stringent fuel quality and emission specifications being satisfied. The synthetic naphtha fuels of the present invention may be blended with conventional diesel fuels to have lower emissions, good cold flow characteristics, low aromatics content and acceptable cetane numbers.

SUMMARY OF THE INVENTION

Thus, according to a first aspect of the invention, there is provided a process for the production of a synthetic naphtha fuel suitable for use in CI engines, the process including at least the steps of:

a) hydrotreating at least a fraction of a Fischer-Tropsch (FT) synthesis reaction product of CO and $H_2$, or a derivative thereof;

b) hydrocracking at least a fraction of the FT synthesis product or a derivative thereof; and c) fractionating the process products to obtain a desired synthetic naphtha fuel characteristic.

The process may include the additional step of blending the fractionated process products in a desired ratio to obtain a synthetic naphtha fuel having desired characteristics for use in a CI engine.

The process as described above may produce a synthetic naphtha wherein some of the desired characteristics include:

having a high Cetane number in excess of 30;

having a low sulfur content below about 5 ppm;

having good cold flow properties; and having more than 30% isoparaffins, wherein the isoparaffins include methyl and/or ethyl branched isoparaffins.

According to yet another aspect of the invention, there is provided a process for producing a synthetic naphtha fuel having a Cetane number higher than 30, the process including:

(a) separating the products obtained from synthesis gas via the FT synthesis reaction into one or more heavier fraction and one or more lighter fraction;

(b) catalytically processing the heavier fraction under conditions which yield predominantly distillates;

(c) separating a naphtha product fraction of step (b) from a heavier product fraction which is also produced in step (b); and (d) optionally, blending the naphtha product obtained in step (c) with at least a portion of the one or more lighter fraction of step (a), or products thereof.

The catalytic processing of step (b) may be a hydroprocessing step, for example, hydrocracking or mild hydrocracking.

The process for producing a synthetic naphtha fuel may include one or more additional step of fractionating at least some of the one or more lighter fraction of step (a), or products thereof, prior to step (d).

The process for producing a synthetic naphtha fuel may include the additional step of hydrotreating at least some of the one or more light fraction of step (a), or products thereof, prior to step (d).

The one or more heavier fraction of step (a) may have a true boiling point (TBP) in the range of about 70° C. to 700° C., however, it may be in the range 80° C. to 650° C.

The one or more lighter fraction may have a true boiling point (TBP) in the range −70° C. to 350° C., typically in the range −10° C. to 340° C.

The product of step (d) may boil in the range 30° C. to 200° C. The product of step (d) may boil in the range 40° C. to 155° C., as measure by the ASTM D86 method.

The product of step (d) may be a naphtha fuel.

The product of step (d) may have a Cloud Point below −30° C., typically −40° C. and even below −50° C.

The product of step (d) may be obtained by mixing the naphtha product fraction obtained in step (c) with at least a portion of the one or more lighter fraction of step (a), or products thereof, in a volume ratio of between 1:24 and 9:1, typically 2:1 and 6:1, and in one embodiment, in a volume ratio of 50:50.

The invention extends further to a process for the production of synthetic naphtha fuels suitable for CI engines, from FT primary products, comprising predominantly short chain linear and branched paraffins.

In this process, the waxy product from the FT process is separated into at least two fractions, a heavier and at least one lighter fraction. The lighter fraction may be subjected to mild catalytic hydrogenation to remove hetero-atomic compounds such as oxygen and to saturate olefins, thereby producing material useful as naphtha, diesel, solvents, and/or blending components therefor. The heavier fraction may be catalytically hydroprocessed without prior hydrotreating to produce products with good cold flow characteristics. This hydroprocessed heavier fraction could be blended with all or part of the hydrogenated and/or unhydrogenated light fraction to obtain, after fractionation, naphtha fuel characterised by an acceptable Cetane number.

The catalysts suitable for the hydroprocessing steps are commercially available and can be selected towards an improved quality of the desired final product.

According to a further aspect of the invention there is provided a process for the production of a synthetic naphtha fuel suitable for use in CI engines, the process including at least the steps of:

a) hydrotreating at least a condensate fraction of a Fischer-Tropsch (FT) synthesis reaction product of CO and $H_2$, or a derivative thereof;

b) hydrocracking at least a wax fraction of the FT synthesis product or a derivative thereof;

c) fractionating the hydrocracked fraction of step b) to obtain desired synthetic naphtha fuel components; and d) blending said components of step c) with the hydrotreated fraction of step a) in a desired ratio to obtain a synthetic naphtha fuel having desired characteristics for use in a CI engine.

The wax fraction of step b) may have a true boiling point (TBP) in the range of about 70° C. to 700° C.

The condensate fraction of step a) generally has a true boiling point (TBP) in the range −70° C. to 350° C.

The fuel of step d) generally boils in the range 30° C. to 200° C., as measured by the ASTM D86 method.

The fuel of step d) may be obtained by mixing the components obtained in step c) with at least a portion of the hydrotreated condensate of step a), or products thereof, in a volume ratio of between 1:24 and 9:1.

The invention extends yet further to a process for the production of a synthetic fuel suitable for use in CI engines, the process including at least the step of blending a synthetic naphtha fuel with a diesel fuel.

The naphtha fuel and diesel fuel may be blended in substantially equal proportions (v/v).

The synthetic naphtha fuel used in the process may be produced according to a process including at least the steps of:

a) hydrotreating at least a condensate fraction of a Fischer-Tropsch (FT) synthesis reaction product of CO and $H_2$, or a derivative thereof;

b) hydrocracking at least a wax fraction of the FT synthesis product or a derivative thereof;

c) fractionating the hydrocracked fraction of step b) to obtain desired synthetic naphtha fuel components; and d) blending said components of step c) with the hydrotreated fraction of step a) in a desired ratio to obtain a synthetic naphtha fuel having desired characteristics for use in a CI engine.

According to a further aspect of the invention, there is provided a synthetic naphtha fuel having a Cetane number above 30 and a Cloud Point below −30° C., said naphtha fuel having an isoparaffinic content substantially as described above.

The synthetic naphtha fuel having a Cetane number above 30, a Cloud Point of below −30° C., more than 30% isoparaffins, may have a Final Boiling Point (FBP) of less than 160° C.

The synthetic naphtha fuel may have an Initial Boiling Point (IBP) of at least 49° C.

In one embodiment, the synthetic naphtha fuel is a FT product.

The invention extends to a fuel composition including from 10% to 100% of a synthetic naphtha fuel as described above.

Typically, the fuel composition may include from 0 to 90% of one or more diesel fuels.

The fuel composition may include at least 20% of the synthetic naphtha fuel, the composition having a Cetane number greater than 40 and a Cloud Point below 2° C. Using the synthetic naphtha as Cloud Point depressor may result in at least 2° C. depression in Cloud Point of the fuel composition.

The fuel composition may include at least 30% of the synthetic naphtha fuel, the composition having a Cetane number greater than 40 and a Cloud Point below 0° C. Using the synthetic naphtha as Cloud Point depressor may result in at least 3° C. depression in Cloud Point for the fuel composition.

The fuel composition may include at least 50% of the synthetic naphtha fuel, the composition having a Cetane number greater than 40 and a Cloud Point below 0° C., more typically below −4° C. Using the synthetic naphtha as Cloud Point depressor may result in at least 4° C. depression in Cloud Point for the fuel composition, or more typically at least 8° C. depression.

The fuel composition may include at least 70% of the synthetic naphtha fuel, the composition having a Cetane number greater than 40 and a Cloud Point below −10° C., more typically below −15° C. Using the synthetic naphtha as Cloud Point depressor may result in at least 13° C. depression in Cloud Point for the fuel composition, or more typically at least 18° C. depression.

The blend composition may further include from 0 to 10% additives to improve other fuel characteristics.

The additives may include a lubricity improver. The lubricity improver may comprise from 0 to 0.5% of the composition, typically from 0.00001% to 0.05% of the composition. In some embodiments, the lubricity improver comprises from 0.008% to 0.02% of the composition.

The fuel composition may include, as the diesel, a crude oil derived diesel, such as US 2-D grade (low sulphur No. 2-D grade for diesel fuel oil as specified in ASTM D 975-94) and/or CARB (California Air Resources Board 1993 specification) diesel fuel, and/or a South African specification commercial diesel fuel.

The invention extends to a Fischer-Tropsch derived Cloud Point depressant for a diesel fuel containing fuel composition, the Cloud Point depressant having a Cetane number above 30, a Cloud Point of below −30° C., more than 30% isoparaffins, and a Final Boiling Point (FBP) of less than 160° C.

The Fischer-Tropsch derived Cloud Point depressant may have an Initial Boiling Point (IBP) of at least 49° C.

DETAILED DESCRIPTION

Figure 1:
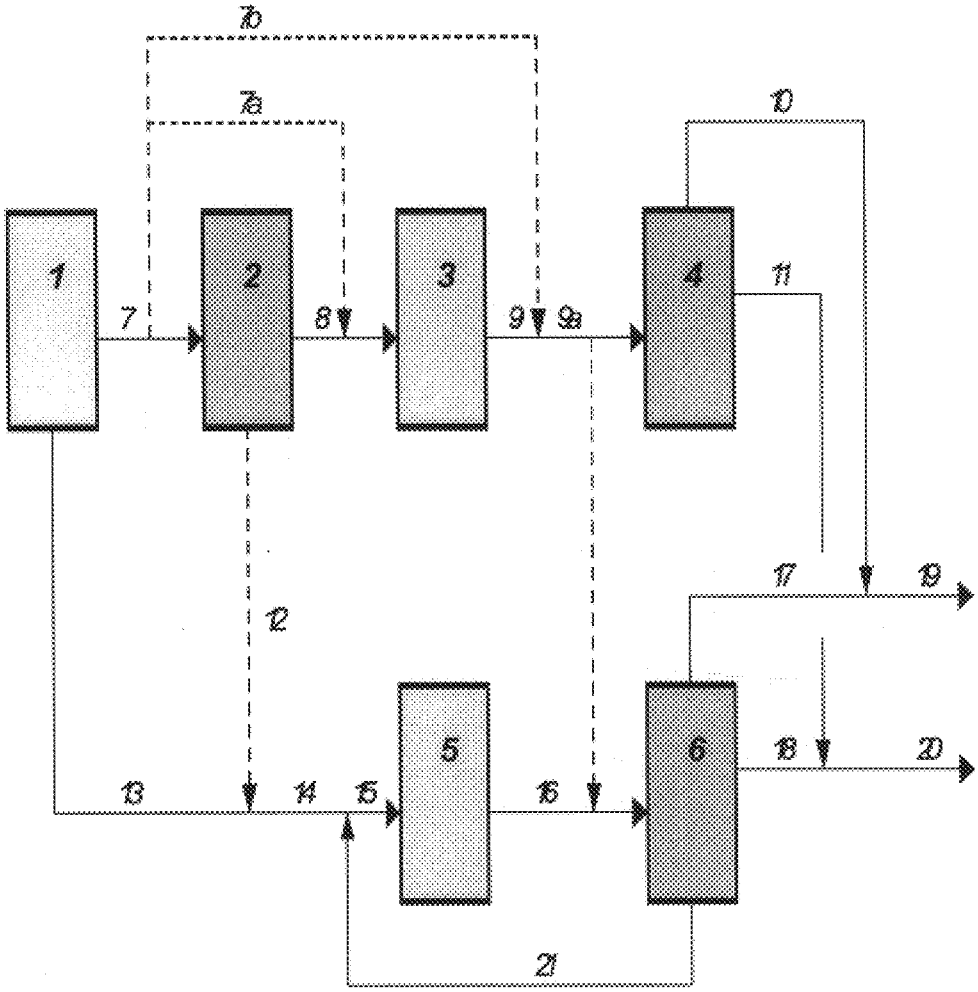
FIG. 1 depicts an example of a process in accordance with the invention.

This invention describes the conversion of primary FT products into naphtha and middle distillates, for example, naphtha fuels having a Cetane number in excess of 30, while also having good cold flow properties, as described above.

The FT process is used industrially to convert synthesis gas, derived from coal, natural gas, biomass or heavy oil streams, into hydrocarbons ranging from methane to species with molecular masses above 1400.

While the main products are linear paraffinic materials, other species such as branched paraffins, olefins and oxygenated components may form part of the product slate. The exact product slate depends on reactor configuration, operating conditions and the catalyst that is employed, as is evident from e.g. Catal.Rev.-Sci. Eng., 23(1&2), 265–278 (1981).

Preferred reactors for the production of heavier hydrocarbons are slurry bed or tubular fixed bed reactors, while operating conditions are preferably in the range of 160° C.–280° C., in some cases 210 –260° C., and 18–50 bar, in some cases 20–30 bar.

Preferred active metals in the catalyst comprise iron, ruthenium or cobalt. While each catalyst will give its own unique product slate, in all cases the product slate contains some waxy, highly paraffinic material which needs to be further upgraded into usable products. The FT products can be converted into a range of final products, such as middle distillates, naphtha, solvents, lube oil bases, etc. Such conversion, which usually consists of a range of processes such as hydrocracking, hydrotreatment and distillation, can be termed a FT work-up process.

The FT work-up process of this invention uses a feed stream consisting of $C_5$ and higher hydrocarbons derived from a FT process. This feed is separated into at least two individual fractions, a heavier and at least one lighter fraction. The cut point between the two fractions is preferably less than 300° C. and typically around 270° C.

The table below gives a typical composition of the two fractions, with 10% accuracy:

TABLE 1

Typical Fischer-Tropsch product after separation into two fractions (vol % distilled)

| | FT Condensate (<270° C. fraction) | FT Wax (>270° C. fraction) |
|---|---|---|
| $C_5$-160° C. | 44 | 3 |
| 160–270° C. | 43 | 4 |
| 270–370° C. | 13 | 25 |
| 370–500° C. | | 40 |
| >500° C. | | 28 |

The >160° C. fraction, contains a considerable amount of hydrocarbon material, which boils higher than the normal naphtha range. The 160° C. to 270° C. fraction may be regarded as a light diesel fuel. This means that all material heavier than 270° C. needs to be converted into lighter materials by means of a catalytic process often referred to as hydroprocessing, for example, hydrocracking.

Catalysts for this step are of the bifunctional type; i.e. they contain sites active for cracking and for hydrogenation. Catalytic metals active for hydrogenation include group VIII noble metals, such as platinum or palladium, or a sulphided Group VIII base metals, e.g. nickel, cobalt, which may or may not include a sulphided Group VI metal, e.g. molybdenum. The support for the metals can be any refractory oxide, such as silica, alumina, titania, zirconia, vanadia and other Group III, IV, VA and VI oxides, alone or in combination with other refractory oxides. Alternatively, the support can partly or totally consist of zeolite. However, for this invention the preferred support is amorphous silica-alumina.

Process conditions for hydrocracking can be varied over a wide range and are usually laboriously chosen after extensive experimentation to optimise the yield of naphtha. In this regard, it is important to note that, as in many chemical reactions, there is a trade-off between conversion and selectivity. A very high conversion will result in a high yield of gases and low yield of naphtha fuels. It is therefore important to painstakingly tune the process conditions in order to optimise the conversion of >160° C. hydrocarbons. Table 2 gives a list of the preferred conditions.

TABLE 2

Process conditions for hydrocracking

| CONDITION | BROAD RANGE | PREFERRED RANGE |
|---|---|---|
| Temperature, ° C. | 150–450 | 340–400 |
| Pressure, bar-g | 10–200 | 30–80 |
| Hydrogen Flow Rate, $m^3_n/m^3$ feed | 100–2000 | 800–1600 |
| Conversion of >370° C. material, mass % | 30–80 | 50–70 |

Nevertheless, it is possible to convert all the >370° C. material in the feedstock by recycling the part that is not converted during the hydrocracking process.

As is evident from table 1, a large proportion of the fraction boiling below 160° C. (light condensate) is already in the typical boiling range for naphtha, i.e. 50–160° C. This fraction may or may not be subjected to hydrotreating. By hydrotreating, hetero-atoms are removed and unsaturated compounds are hydrogenated. Hydrotreating is a well-known industrial process, catalysed by any catalyst having a hydrogenation function, e.g. Group VIII noble metal or sulphided base metal or Group VI metals, or combinations thereof. Preferred supports are alumina and silica.

Table 3 gives typical operating conditions for the hydrotreating process.

TABLE 3

Operating conditions for the hydrotreating process.

| CONDITION | BROAD RANGE | PREFERRED RANGE |
|---|---|---|
| Temperature, ° C. | 150–450 | 200–400 |
| Pressure, bar (g) | 10–200 | 30–80 |
| Hydrogen Flow Rate, $m^3_n/m^3$ feed | 100–2000 | 400–1600 |

While the hydrotreated fraction may be fractionated into paraffinic materials useful as solvents, the applicant has now surprisingly found that the hydrotreated fraction may be directly blended with the products obtained from hydrocracking the wax. Although it is possible to hydroisomerise the material contained in the condensate stream, the applicant has found that this leads to a small, but significant loss of material in the naphtha boiling range to lighter material. Furthermore, isomerisation leads to the formation of branched isomers, which leads to Cetane ratings less than that of the corresponding normal paraffins.

Important parameters for a FT work-up process are maximization of product yield, product quality and cost. While the proposed process scheme is simple and therefore cost-effective, it produces synthetic naphtha fuels suitable for CI engines, having a Cetane number >30 in good yield. In fact, the process of this invention is able to produce a naphtha for use in a CI engine of hitherto unmatched quality, which is characterized by a unique combination of both acceptable Cetane number and excellent cold flow properties.

It is the unique composition of the synthetic naphtha fuel, which is directly caused by the way in which the FT work-up process of this invention is operated, that leads to the unique characteristics of said fuel.

The described FT work-up process of FIG. 1 may be combined in a number of configurations. The applicant considers these an exercise in what is known in the art as Process Synthesis Optimisation.

However, the specific process conditions for the Work-up of FT primary products, the possible process configurations of which are outlined in Table 4, were obtained after extensive and laborious experimentation and design.

TABLE 4

Possible Fischer-Tropsch Product Work-up Process Configurations

| | Process Step | Process Scheme A | B | C | D |
|---|---|---|---|---|---|
| 1 | FT Synthesis Reactor | X | X | X | X |
| 2 | Light FT Product Fractionator | X | | | |
| 3 | Light FT Product Hydrotreater | X | X | X | X |
| 4 | Light HT FT Product Fractionator | | | X | X |
| 5 | Waxy FT Product Hydrocracker | X | X | X | X |
| 6 | Product Fractionator | X | X | X | X |

Numbers reference numerals of FIG. 1
FT Fischer-Tropsch

The basic process is outlined in the attached FIG. 1. The synthesis gas (syngas), a mixture of Hydrogen and Carbon monoxide, enters the FT reactor 1 where the synthesis gas is converted to hydrocarbons by the FT reaction.

A lighter FT fraction is recovered in line 7, and may or may not pass through fractionator 2 and hydrotreater 3. The product 9 from the hydrotreater may be separated in fractionator 4 or, alternatively, mixed with hydrocracker products 16 sent to a common fractionator 6.

A waxy FT fraction is recovered in line 13 and sent to hydrocracker 5. If fractionation 2 is considered the bottoms cut 12 are to be sent to hydrocracker 5. The products 16, on their own or mixed with the lighter fraction 9*a*, are separated in fractionator 6.

Depending on the process scheme, a light product fraction, naphtha 19, is obtained from fractionator 6 or by blending equivalent fractions 10 and 17. This is a typically $C_5$–160° C. fraction useful as naphtha.

A somewhat heavier cut, synthetic diesel 20, is obtainable in a similar way from fractionator 6 or by blending equivalent fractions 11 and 18. This cut is typically recovered as a 160–370° C. fraction useful as diesel.

The heavy unconverted material 21 from fractionator 6 is recycled to extinction to hydrocracker 5. Alternatively, the residue may be used for production of synthetic lube oil bases. A small amount of $C_1$–$C_4$ gases are also separated in fractionators 4 and 6.

The following examples 1–9 will serve to illustrate further this invention.

NONMENCLATURE USED IN EXAMPLES

LTFT Low Temperature Fischer-Tropsch. A Fischer-Tropsch synthesis completed at temperatures between 160° C. and 280° C., using the basic process conditions as described previously in this patent, at pressures of 18 to 50 bar in a tubular fixed bed or slurry bed reactor.

SR Straight Run. A product obtained directly from LTFT that has not been subjected to any chemical transformation process.

HT SR Hydrogenated Straight Run. A product obtained from LTFT SR products after being hydrogenated using the basic process conditions as described previously in this patent.

HX Hydrocracked. A product obtained from LTFT SR products after being hydrocracked using the basic process conditions as described previously in this patent.

EXAMPLE 1

A Straight Run (SR) naphtha was produced by fractionation of the light FT Condensate. This product had the fuel characteristics indicated in Table 5. The same table contains the basic properties of a petroleum based diesel fuel.

EXAMPLE 2

A Hydrogenate Straight Run (HT SR) naphtha was produced by hydrotreating and fractionation of the light FT Condensate. This product had the fuel characteristics indicated in Table 5.

EXAMPLE 3

A Hydrocracked (HX) naphtha was produced by hydrocracking and fractionation of the heavy FT wax. This product had the fuel characteristics indicated in Table 5.

EXAMPLE 4

A LTFT Naphtha was produced by blending of the naphthas described in examples 2 and 3. The blending ratio was 50:50 by volume. This product had the fuel characteristics indicated in Table 5.

TABLE 5

Characteristics of the LTFT Naphthas

| | Synthetic FT Naphthas SR | HT SR | HX | LTFT | Commercial SA Diesel | Notes |
|---|---|---|---|---|---|---|
| ASTM D86 | | | | | | |
| IBP, ° C. | 58 | 60 | 49 | 54 | 182 | |
| T10, ° C. | 94 | 83 | 79 | 81 | 223 | |
| T50, ° C. | 118 | 101 | 101 | 101 | 292 | |

TABLE 5-continued

| Characteristics of the LTFT Naphthas | | | | | | |
|---|---|---|---|---|---|---|
| | Synthetic FT Naphthas | | | | Commercial | |
| | SR | HT SR | HX | LTFT | SA Diesel | Notes |
| T90, ° C. | 141 | 120 | 120 | 120 | 358 | |
| FBP, ° C. | 159 | 133 | 131 | 131 | 382 | |
| Density, kg/L (20° C.) | 0.7101 | 0.6825 | 0.6877 | 0.6852 | 0.8483 | |
| Cetane Number | n/a | 42.7 | 30.0 | 39.6 | 50.0 | |
| Heat of Combustion, HHV, kJ/kg | 45 625 | 48 075 | 46 725 | 46 725 | 45 520 | note 2 |
| Acid Number, mg KOH/g | 0.361 | 0.001 | 0.011 | 0.006 | 0.040 | |
| Total sulphur, mg/L | <1 | <1 | <1 | <1 | 4 242 | |
| Composition, % wt | | | | | | |
| n-paraffins | 53.2 | 90.1 | 28.6 | 59.0 | n/a | |
| Iso-paraffins | 1.2 | 8.3 | 66.7 | 38.2 | n/a | |
| Naphthenics | — | — | — | — | n/a | |
| Aromatics | — | 0.1 | 0.5 | 0.3 | n/a | |
| olefins | 35.0 | 1.5 | 4.2 | 2.5 | n/a | |
| alcohols | 10.7 | — | — | — | n/a | |
| Cloud Point, ° C. | −51 | −54 | −35 | −33 | 4 | |
| Flash Point, ° C. | −9 | −18 | −21 | −20 | 57 | note 3 |
| Viscosity | n/a | n/a | n/a | 0.50 | 3.97 | |

Notes:
1. These fuels contain no additives;
2. API Procedure 14A1.3;
3. Correlated (ref.: HP Sep 1987 p. 81)

EXAMPLE 5

The SR Naphtha, described in example 1, was tested for emissions obtaining the results indicated in table 6. A Mercedes Benz 407T Diesel engine was used for the test, with the characteristics also indicated in table 6. The emissions measured during the test were 21.6% less CO, 4.7% less $CO_2$, and 20.0% less $NO_X$ than that those measured for the conventional diesel fuel. Additionally, the Particulates emission measured by the Bosch Smoke Number was 52% lower than that observed for the conventional diesel fuel. The specific fuel consumption was 0.2% lower than that observed for the conventional diesel.

EXAMPLE 6

The HT SR Naphtha, described in example 2, was tested for emissions obtaining the results indicated in table 6. A Mercedes Benz 407T Diesel engine was used for the test, with the characteristics also indicated in table 6. The emissions measured during the test were 28.8% less CO, 3.5% less $CO_2$, and 26.1% less $NO_X$ than that those measured for the conventional diesel fuel. Additionally, the Particulates emission measured by the Bosch Smoke Number was 45% lower than that observed for the conventional diesel fuel. The specific fuel consumption was 4.9% lower than that observed for the conventional diesel.

EXAMPLE 7

The HX Naphtha, described in example 3, was tested for emissions obtaining the results indicated in table 6. A Mercedes Benz 407T Diesel engine was used for the test, with the characteristics also indicated in table 6. The emissions measured during the test were 7.2% less CO, 0.3% less $CO_2$, and 26.6% less $NO_X$ than that those measured for the conventional diesel fuel. Additionally, the Particulates emission measured by the Bosch Smoke Number was 54% lower than that observed for the conventional diesel fuel. The specific fuel consumption was 7.1% lower than that observed for the conventional diesel.

EXAMPLE 8

The LTFT Naphtha, described in example 4, was tested for emissions obtaining the results indicated in table 6. An unmodified Mercedes Benz 407T Diesel engine was used for the test, with the characteristics also indicated in table 6. The emissions measured during the test were 25.2% less CO, 4.4% less $CO_2$, and 26.1% less $NO_X$ than that those measured for the conventional diesel fuel. Additionally, the Particulates emission measured by the Bosch Smoke Number was 45% lower than that observed for the conventional diesel fuel. The specific fuel consumption was 4.6% lower than that observed for the conventional diesel.

TABLE 6

| CI Engine and Emissions Performance of the Synthetic Naphthas | | | | | |
|---|---|---|---|---|---|
| | Synthetic Naphthas | | | | Conventional |
| | SR | HT SR | HX | LTFT | Diesel |
| Test Data | | | | | |
| Engine | Mercedes Benz 407T | | | | |
| Test condition | 1 400 rpm | | | | |
| Load | 553 Nm | | | | |
| Fuel | | | | | |
| Consumption, kg/h | 17.55 | 16.72 | 16.34 | 16.77 | 17.58 |
| Emissions | | | | | |
| CO, g/kWh | 0.87 | 0.79 | 1.03 | 0.83 | 1.11 |
| $CO_2$, g/kwh | 668.1 | 676.1 | 698.9 | 670.1 | 700.9 |
| $NO_X$, g/kwh | 13.59 | 12.55 | 12.47 | 12.55 | 16.99 |
| Exhaust Smoke | | | | | |
| Bosh Smoke Number | 0.32 | 0.37 | 0.31 | 0.37 | 0.67 |

EXAMPLE 9

The LTFT Naphtha was blended in a 50:50 proportion (volume) with a commercial South African diesel to produce a fuel suitable for cold weather environments. The fuel characteristics of this fuel and its components are included in Table 7. In Table 8 the performance of this fuel blend, and that of its components, in a Compression Ignition (CI) Engine are shown. The 50:50 blend shows 10% lower specific fuel consumption, 19% lower NOx emissions and 21% lower Bosch Smoke Number. Other parameters are also significant.

The commercial diesel fuel is a conventional non-winter fuel grade. Conventionally petroleum refiners producing diesel fuels for cold weather environments are forced to reduce the final boiling points of their products. By doing this, they reduce the cold flow characteristics, making it more compatible with low temperature operation and reducing the possibility of freezing. This results in lower production levels, not only for diesel fuels but also for jet fuel and other products like heating oils.

The blend of the LTFT Naphtha and the commercial South African Diesel is a fuel suitable for cold weather environments that can be prepared without reducing production of conventional fuel. The blend retains the advantages of conventional fuels, including acceptable cetane number and flash points, and can be used in cold conditions without additives or loss of performance. Additionally the blend might have environmental advantages in respect to emissions.

Some of the results included in Tables 7 and 8 are illustrated graphically in the attached figures at the end of the Examples.

TABLE 7

Fuel Characteristics of the Commercial Diesel-Synthetic Naphtha Blends

| | | LTFT Naphtha in Blend | | |
|---|---|---|---|---|
| | | 0% | 50% | 100% |
| ASTM D86 | IBP | 182 | 50 | 53 |
| Distillation | T10 | 223 | 87 | 79 |
| ° C. | T50 | 292 | 129 | 100 |
| | T90 | 358 | 340 | 120 |
| | FBP | 382 | 376 | 129 |
| Specific Gravity | | 0.8483 | 0.7716 | 0.6848 |
| Flash Point | ° C. | 77 | 47 | −20 |
| Viscosity | cSt 40° C. | 3.97 | 1.19 | 0.50 |
| Cetane Number | | 50.0 | 41.8 | 39.6 |
| Cloud Point (DSC) | ° C. | 4 | −5 | −35 |
| CFPP | ° C. | −6 | −16 | −40 |

TABLE 8

CI Engine and Emissions Performance of the Commercial Diesel-Synthetic Naphtha Blends

| | LTFT Naphtha in Blend | | |
|---|---|---|---|
| | 0% | 50% | 100% |
| Engine tested | Mercedes Benz 407T | | |
| Test condition | 1 400 rpm | | |
| Engine load | 553 Nm | | |
| Fuel Consumption, kg/h | 17.58 | 16.71 | 16.77 |
| Emissions | | | |
| CO, g/kWh | 1.11 | 1.21 | 0.83 |
| $CO_2$, g/kwh | 700.9 | 711.6 | 670.1 |
| $NO_X$, g/kwh | 16.99 | 13.85 | 12.55 |
| Bosch Smoke Number | 0.67 | 0.53 | 0.37 |

Combustion and Emissions Performance of the Synthetic Naphthas

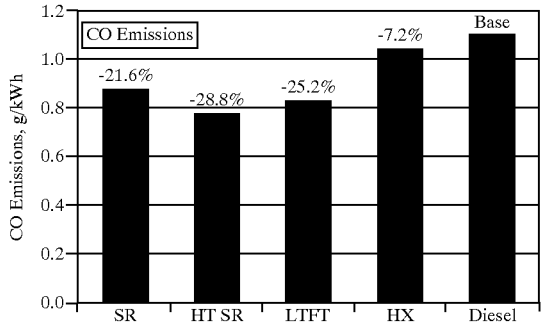

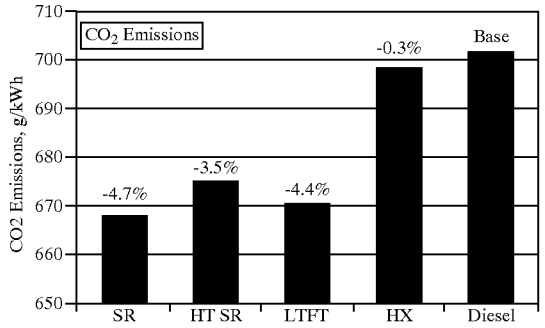

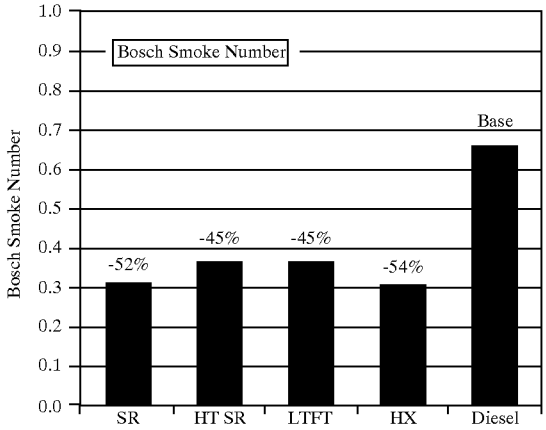

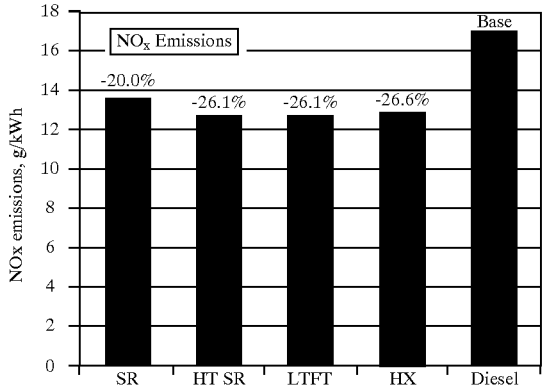
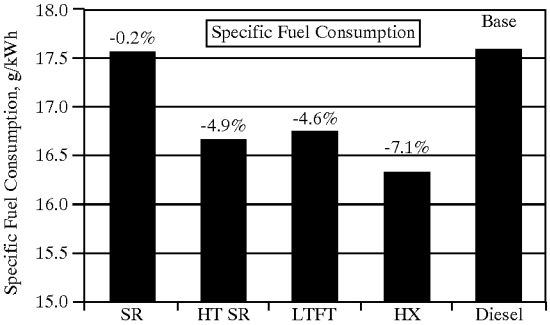
Combustion and Emissions Performance of
the LTFT Synthetic Naphtha and Commercial Diesel Blend
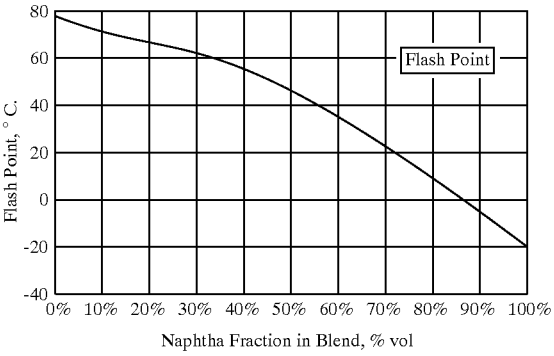
-continued
Combustion and Emissions Performance of
the LTFT Synthetic Naphtha and Commercial Diesel Blend
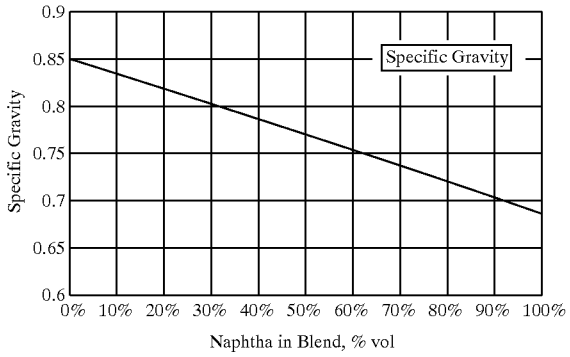
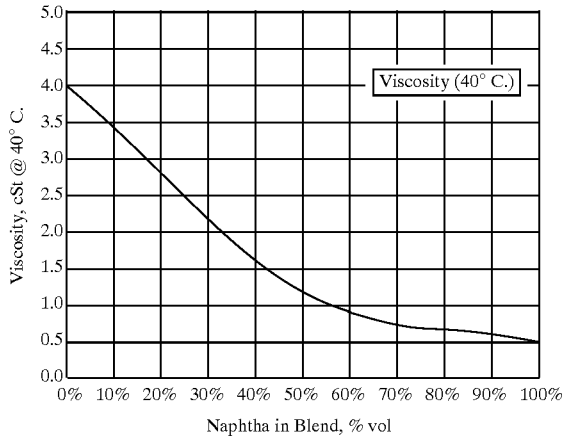
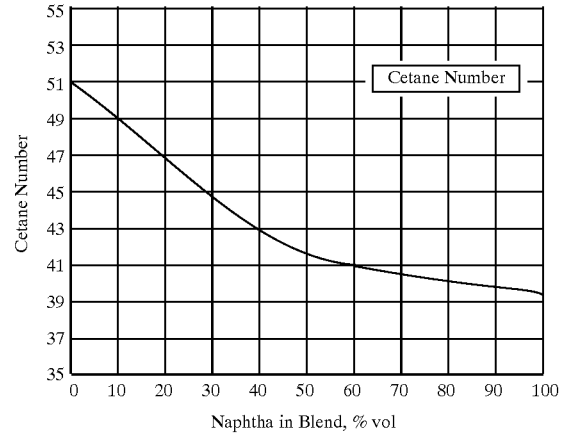

-continued

Combustion and Emissions Performance of the LTFT Synthetic Naphtha and Commercial Diesel Blend

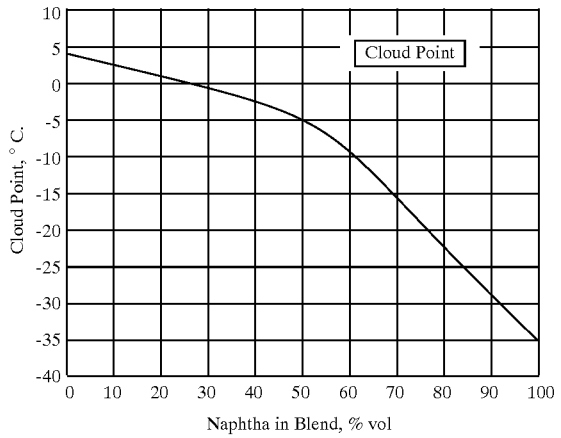

What is claimed is:

1. A process for the production of synthetic fuel suitable for use in CI engines, the process including at least the step of blending a synthetic naphtha fuel with diesel fuel, wherein the synthetic naphtha fuel is produced according to a process including at least the steps of:

a) hydrotreating at least a condensate fraction of a Fischer-Tropsch (FT) synthesis reaction product of CO and $H_2$, or a derivative thereof;

b) hydrocracking at least a wax fraction of the FT synthesis product or a derivative thereof;

c) fractionating the hydrocracked fraction of step b) to obtain desired synthetic naphtha fuel components; and d) blending said components of step c) with the hydrotreated fraction of step a) in a desired ratio to obtain a synthetic naphtha fuel having desired characteristics for use in a CI engine.

2. A Fischer-Tropsch derived synthetic naphtha fuel having a Cetane number above 30, a Cloud Point of below −30° C., more than 30% isoparaffins, and a Final Boiling Point (FBP) of less than 160° C.

3. A synthetic naphtha fuel as claimed in claim 2, having an Initial Boiling Point (IBP) of at least 49° C.

4. A fuel composition including from 1% to 100% of a synthetic naphtha fuel as claimed in claim 2.

5. A fuel composition including from 1% to 100% of a synthetic naphtha fuel as claimed in claim 3.

6. A fuel composition as claimed in claim 4, which includes from 0 to 99% of one or more diesel fuels.

7. A fuel composition as claimed in claim 4, which includes at least 20% of the synthetic naphtha fuel, the composition having a Cetane number greater than 40 and a Cloud Point below 2° C.

8. A fuel composition as claimed in claim 4, which includes at least 30% of the synthetic naphtha fuel, the composition having a Cetane number greater than 40 and a Cloud Point below 0° C.

9. A fuel composition as claimed in claim 4, which includes at least 50% of the synthetic naphtha fuel, the composition having a Cetane number greater than 40 and a Cloud Point below −4° C.

10. A fuel composition as claimed in claim 4, which includes at least 70% of the synthetic naphtha fuel, the composition having a Cetane number greater than 40 and a Cloud Point below −13° C.

11. A fuel composition as claimed in claim 6, which includes equal volumes of the synthetic naphtha fuel and the diesel fuel and has a Cetane number greater than 40 and a Cloud Point below −5° C.

12. A Fischer-Tropsch derived Cloud Point depressant for a diesel fuel containing fuel composition, the Cloud Point depressant having a Cetane number above 30, a Cloud Point of below −30° C., more than 30% isoparaffins, and a Final Boiling Point (FBP) of less than 160° C.

13. A Fischer-Tropsch derived Cloud Point depressant as claimed in claim 12, the Cloud Point depressant having an Initial Boiling Point (IBP) of at least 49° C.

* * * * *